United States Patent [19]

Okazaki

[11] Patent Number: 4,897,060

[45] Date of Patent: Jan. 30, 1990

[54] EXHAUST SYSTEM FOR OUTBOARD MOTORS

[75] Inventor: Masaki Okazaki, Shizuoka, Japan

[73] Assignees: Yamaha Hatsudoki; Sanshin Kogyo, both of Shizuoka, Japan

[21] Appl. No.: 681,705

[22] Filed: Dec. 13, 1984

Related U.S. Application Data

[63] Continuation of Ser. No. 486,406, Apr. 19, 1983, abandoned.

[30] Foreign Application Priority Data

Apr. 24, 1982 [JP] Japan ..... 57-68908

[51] Int. Cl.[4] ..... B63H 21/32

[52] U.S. Cl. ..... 440/89; 181/272

[58] Field of Search ..... 440/88, 89, 77; 181/229, 250, 233, 260, 266, 272, 273, 276; 60/310, 312, 314

[56] References Cited

U.S. PATENT DOCUMENTS 3,045,423 7/1962 Hulsebus ..... 440/89
4,145,988 3/1979 Harada ..... 440/89
4,172,508 10/1979 Moss et al. ..... 181/272
4,192,401 3/1980 Deaver et al. ..... 181/273
4,421,490 12/1983 Nakahama ..... 440/89

FOREIGN PATENT DOCUMENTS 119908 9/1980 Japan ..... 440/89

*Primary Examiner*—Joseph F. Peters, Jr.
*Assistant Examiner*—Jesûs D. Sotelo
*Attorney, Agent, or Firm*—Ernest A. Beutler

[57] ABSTRACT

Two embodiments of improved exhaust gas systems for outboard motors. In each system, the slow speed exhaust gases go through at least three expansions and contractions before discharge to the atmosphere. In one embodiment of the invention, the slow speed exhaust gases go through four expansions and contractions. In each embodiment of the invention, one of the expansion chambers has communication with another expansion chamber through a neck that is tuned whereby the neck and the one expansion chamber function as a Helmholtz resonator for tuning intermediate and high speed exhaust gas discharge.

16 Claims, 3 Drawing Sheets

EXHAUST SYSTEM FOR OUTBOARD MOTORS

This application is a continuation of application Ser. No. 486,406, filed Apr. 19, 1983, now abandoned.

BACKGROUND OF THE INVENTION

This invention relates to an exhaust system for outboard motors and more particularly to an improved exhaust system that offers better silencing both under high speed and low speed running.

As is well known, it has been the practice to discharge the exhaust gases of the engine of an outboard motor at a level beneath the water level during running at speed. The exhaust gases may be discharged through a hollow hub of the driving propeller or in proximity to the propeller so that some silencing effect will be accomplished under water. However, when the engine is operating at low speeds and the associated watercraft is traveling at a low speed, the underwater exhaust gas discharge will be submerged to a greater extent than when running at high speeds. Therefore, under slow speed running, the exhaust gases will be subjected to considerable back pressure and poor running and poor efficiency will result. To overcome this problem, it has been proposed to provide an above the water level slow speed exhaust for outboard motors. The exhaust gases are discharged through this slow speed exhaust under low speed running when the main exhaust outlet is submerged to a fairly large extent.

When an above water exhaust gas outlet is incorporated, it is obvious that there will be a substantial diminution of exhaust gas silencing. Although various devices have been proposed for silencing the above the water slow speed exhaust gas outlet, such devices have not provided the requisite degree of silencing. In addition, it is desirable to prevent the discharge of any significant amount of exhaust gases from the slow speed exhaust opening when operating at high speeds to prevent the discharge of unmuffled exhaust gases.

It is, therefore, a principal object of this invention to provide an improved slow exhaust gas silencing system for an outboard motor.

It is another object of this invention to provide an exhaust system for outboard motor having an above the water slow speed exhaust gas outlet that effectively silences the slow speed exhaust gases.

In addition to the problems of providing effective silencing for the slow speed exhaust gases, general silencing of exhaust gases in outboard motors presents several problems. Normally, the exhaust system of an outboard motor includes an exhaust pipe that extends from the exhaust outlet of the engine and which terminates in an expansion chamber. Such arrangements are normally tuned to effect silencing and both the volume of the expansion chamber and the length of the exhaust pipe are critical in achieving the desired silencing. In addition, it has been proposed to use resonant chambers either in lieu of or in combination with expansion chambers to further improve exhaust gas silencing. However, the relatively small size of the outboard motor and its relatively short height has made it difficult if not impossible with prior art constructions to achieve the desired degree of silencing. Normally, the exhaust gas silencing chambers and exhaust pipe extend through the drive shaft housing of the motor. Of course, such drive shaft housings have only limited size and must also accommodate other components of the motor such as the drive shaft.

It is, therefore, a further object of this invention to provide an improved high efficiency exhaust silencing system for an outboard motor.

It is another object of this invention to provide an outboard motor exhaust silencing arrangement wherein silencing may be achieved over a wide range of engine speeds.

SUMMARY OF THE INVENTION

A first feature of this invention is adapted to be embodied in an exhaust system for an outboard motor or the like having an engine with an exhaust outlet, an expansion chamber, means for communicating exhaust gases from the exhaust outlet with the expansion chamber, a high speed exhaust gas discharge normally disposed below the surface of the water when the motor is propelling a watercraft at speed, and means for delivering exhaust gases to the high speed exhaust gas discharge. In accordance with this feature of the invention, a second expansion chamber is provided that communicates with the first expansion chamber through a restricted passage. A slow speed exhaust gas discharge communicates with the second expansion chamber and with the atmosphere above the water level for silencing exhaust gases during slow speed running.

Another feature of the invention is adapted to be embodied in an exhaust system for an outboard motor or the like having an engine with an exhaust outlet, an expansion chamber, means including an exhaust pipe for delivering exhaust gases from the exhaust outlet to the expansion chamber, an exhaust gas discharge normally disposed below the surface of the water when the motor is propelling a watercraft, and means for delivering exhaust gases from the expansion chamber to the exhaust gas discharge. In accordance with this feature of the invention, the exhaust pipe extends through a wall that divides the expansion chamber into two parts. The exhaust pipe extends through a first part and terminates in a second part of the expansion chamber. An annular opening in the wall through which the exhaust pipe passes communicates the parts of the expansion chamber with each other.

Yet a further feature of this invention is adapted to be embodied in an exhaust system for an outboard motor or the like having an engine with an exhaust outlet, an expansion chamber, means for delivering exhaust gases from the exhaust outlet to the expansion chamber, a high speed exhaust gas discharge normally disposed below the surface of the water when the motor is propelling a watercraft at speed, and means for delivering exhaust gases from the expansion chamber to the high speed exhaust gas discharge. In accordance with this feature of the invention, a slow speed exhaust gas discharge is positioned above the water level. A second expansion chamber communicates with the first expansion chamber and a third expansion chamber communicates with the second expansion chamber. Means communicate the third expansion chamber with the slow speed exhaust gas discharge for effecting silencing of the slow speed exhaust gases through a series of expansions and contractions.

DETAILED DESCRIPTION OF THE PREFERRED EMBODIMENTS

Figure 1:
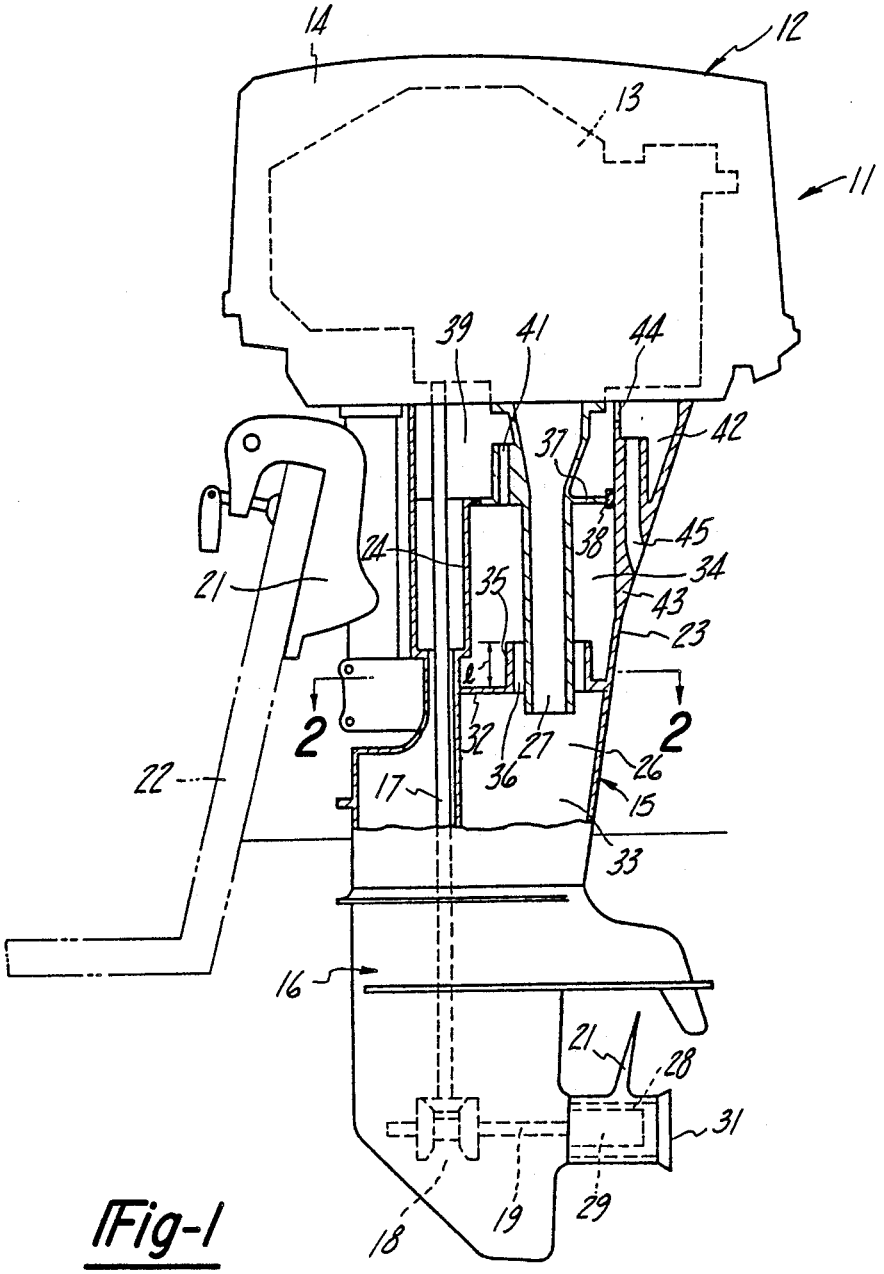
FIG. 1 is a side elevational view of an outboard motor constructed in accordance with a first embodiment of the invention, as attached to the transom of a watercraft (shown partially in phantom) and with portions broken away.
Figure 2:
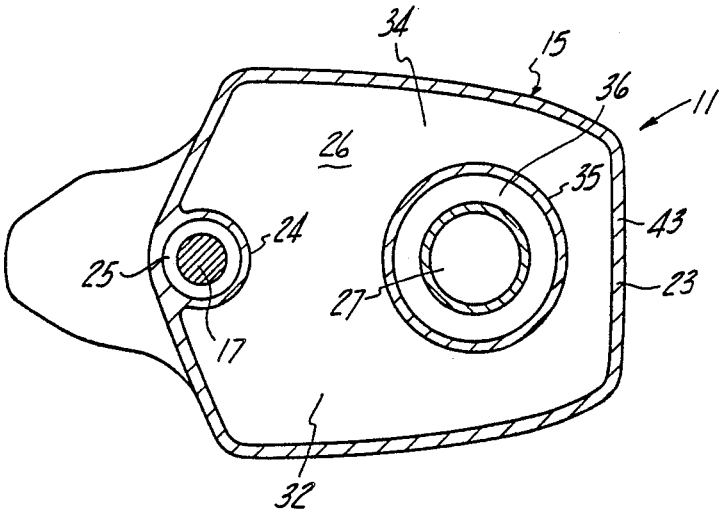
FIG. 2 is a cross-sectional view taken along the line 2—2 of FIG. 1.

Referring first to FIGS. 1 and 2, an outboard motor constructed in accordance with a first embodiment of this invention is identified generally by the reference numeral 11. The motor 11 includes a power head 12 that encloses an internal combustion engine of any known type 13 and which is surrounded by a protective cowling 14. The cowling 14 may be formed of any known material normally used for this purpose such as reinforced fiberglass or the like. A drive shaft housing assembly, indicated generally by the reference numeral 15 depends from the power head 12 and carries a lower unit 16 at its lower end.

The engine 13 drives a drive shaft 17 that extends downwardly through the drive shaft housing 15 and which terminates in the lower unit 16. The drive shaft 17 drives a forward/neutral/reverse transmission, indicated at 18, which also may be of any known type. The transmission 18 permits selective driving connection to a propeller shaft 19 to which a propeller 21 is affixed in a known manner.

A clamping bracket 21 is provided for detachably affixing the motor 11 to a transom 22 of an associated watercraft for propelling of the watercraft by the motor 11. As is well known in this art, the motor 11 is supported for tilting movement about a substantially horizontally extending axis relative to the clamping bracket 21. In addition, the motor 11 is supported for steering movement about a generally vertically extending axis, in a known manner, relative to the clamping bracket 21. Since the tilting and steering arrangements are well known in this art, they have not been illustrated nor will they be described further.

The drive shaft housing 15 is formed from a unitary casting made from a light alloy such as aluminum and has an outer wall 23. An integral internal wall 24 extends inwardly from the forward end of the outer wall 23 and defines an opening 25 through which the drive shaft 17 extends. The outer and inner walls 23, 24 define a generally vertically extending expansion chamber, indicated generally by the reference numeral 26.

An exhaust pipe 27 is affixed to the underside of the engine 13 and defines an exhaust gas passage that communicates with the exhaust gas outlet opening or openings of the engine 13 for delivering the exhaust gases to the expansion chamber 26. The lower end of the chamber 26 communicates with an exhaust gas passage formed in the lower unit 16 which, in turn, delivers the exhaust gases to a high speed exhaust gas discharge 28 formed in a hollow portion of a hub 29 of the propeller 21. This propeller exhaust gas passage 28 terminates in a high speed exhaust gas outlet 31 that is normally positioned beneath the level of the water in which the motor 11 is operating. The construction of the exhaust system, as thus far described, is convention and particularly the underwater exhaust gas high speed discharge. Although a propeller hub type discharge has been described, it is to be understood that the invention can be used with other forms of high speed exhaust gas outlets, such as those which discharge the exhaust gases in proximity to the propeller 21 rather than through it.

The drive shaft housing 15 is formed with an integral, horizontally extending wall 32 that divides the expansion chamber 15 into a lower part 33 and an upper part 34. The wall 32 has an upstanding cylindrical flange 35 that is of greater diameter than the exhaust pipe 27. The exhaust pipe 27 extends through the upper expansion chamber part 34, through the flange 35 and terminates in the lower expansion chamber part 33. The difference in diameters between the inner wall of the flange 36 and the outer wall of the exhaust pipe provides an annular gap 36 that permits communication between the expansion chamber parts 33 and 34.

Near its upper end, the exhaust pipe 27 is formed with an integral outstanding flange 37. The flange 37 engages a seal 38 at its outer periphery which, in turn, engages the walls 23 and 24 so as to define a further expansion chamber 39. The expansion chamber part 34 communicates with the expansion chamber 39 through a restricted passageway 41 formed in the wall 37. A still further expansion chamber 42 is formed between a rear wall 43 of the drive shaft housing 15 and an upstanding partition thereof. The expansion chamber 39 communicates with the expansion chamber 42 through a further restricted opening 44 in this upstanding partition. Exhaust gases may be delivered to the atmosphere from the expansion chamber 42 through a slow speed exhaust gas outlet 45 formed in the drive shaft housing rear wall 43 above the normal water level.

When running at slow speed, the watercraft 22 will be operating lower in the water than when it is running at high speed. As a result, the propeller exhaust outlet 31 is fairly deeply submerged and the water pressure will prevent any significant exhaust gas discharge from the propeller outlet 31. Therefore, exhaust gases will be delivered by the exhaust pipe 28 to the expansion chamber part 33 wherein they undergo a first expansion. The gases will then be passed through the annular gap 36 into the expansion chamber part 34 for a second expansion. The exhaust gases then flow through the restricted passageway 41 and enter the expansion chamber 39 where they undergo a third expansion. The gases then flow through the opening 44, which is also restricted, into the expansion chamber 42 to undergo a fourth expansion. These exhaust gases, having thus been silenced by the repeated expansions and contractions, are discharged to the atmosphere through the slow speed exhaust discharge 45.

When operating at intermediate or high speeds, the boat 22 assumes a shallower depth in the water. Thus, the propeller outlet 31 is raised and the back pressure created by the water on this outlet is reduced. At the same time, the exhaust gases will have a greater pressure and, therefore, as the speed of the watercraft 22 and engine 13 increase, the exhause gases will commence to be discharged through th propeller outlet 31.

Under these conditions, the exhaust gases are silenced by their expansion upon entering the expansion chamber part 35 from the elongated exhaust pipe 27. This silencing effect can be tuned by appropriately selecting the length of the pipe 27 and the volume of the expansion chamber part 33. In addition to this silencing effect, the passage 36 and expansion chamber 34 function as a Helmholtz resonator. As is well known, the silencing effect of this resonator is determined by the relationship of the speed of the engine (N), the length of the passage 36 (l in centimeters), the effective area of the passage 36 in square centimeters (S), the capacity of the expansion chamber 34 in cubic centimeters (V), and the velocity of sound in centimeters per second (C) by the following equation:

$$N = \frac{30C}{m} \sqrt{\frac{S}{(3.14\,l + 2.78\sqrt{S})V}},$$

wherein m is the order of resonance such as first, second, third, etc.

Under intermediate and high speed running, there will be substantially no exhaust gases discharged to the atmosphere through the slow speed exhaust gas discharge 45 because of the presence of the restrictions 41 and 44 between the chamber 34 and this exhaust gas discharge.

Therefore, the construction of this embodiment provides effective silencing in a relatively small volume both at low speeds and also at intermediate and high speeds. In addition, the internal partitions formed by the walls 32 and flange 37 as well as the upstanding flange 35 add further to the rigidity of the drive shaft housing assembly 15. By increasing the rigidity, the transmission of vibrations and the amplification of them is still further reduced.

Figure 4:
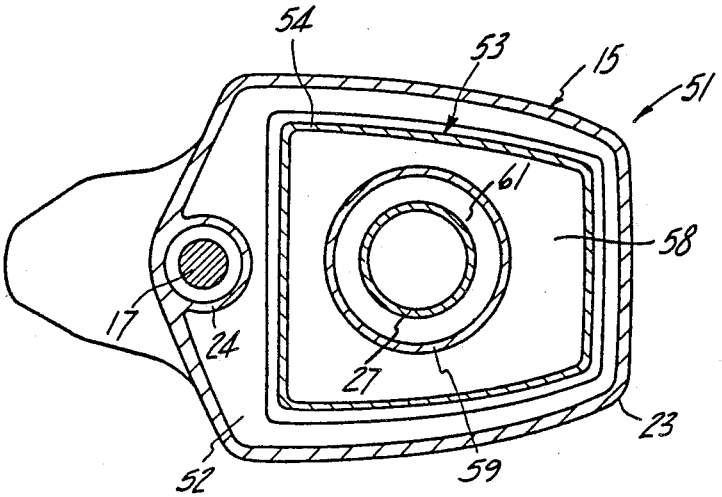
FIG. 4 is a cross-sectional view taken along the line of 4—4 of FIG. 3.
Figure 3:
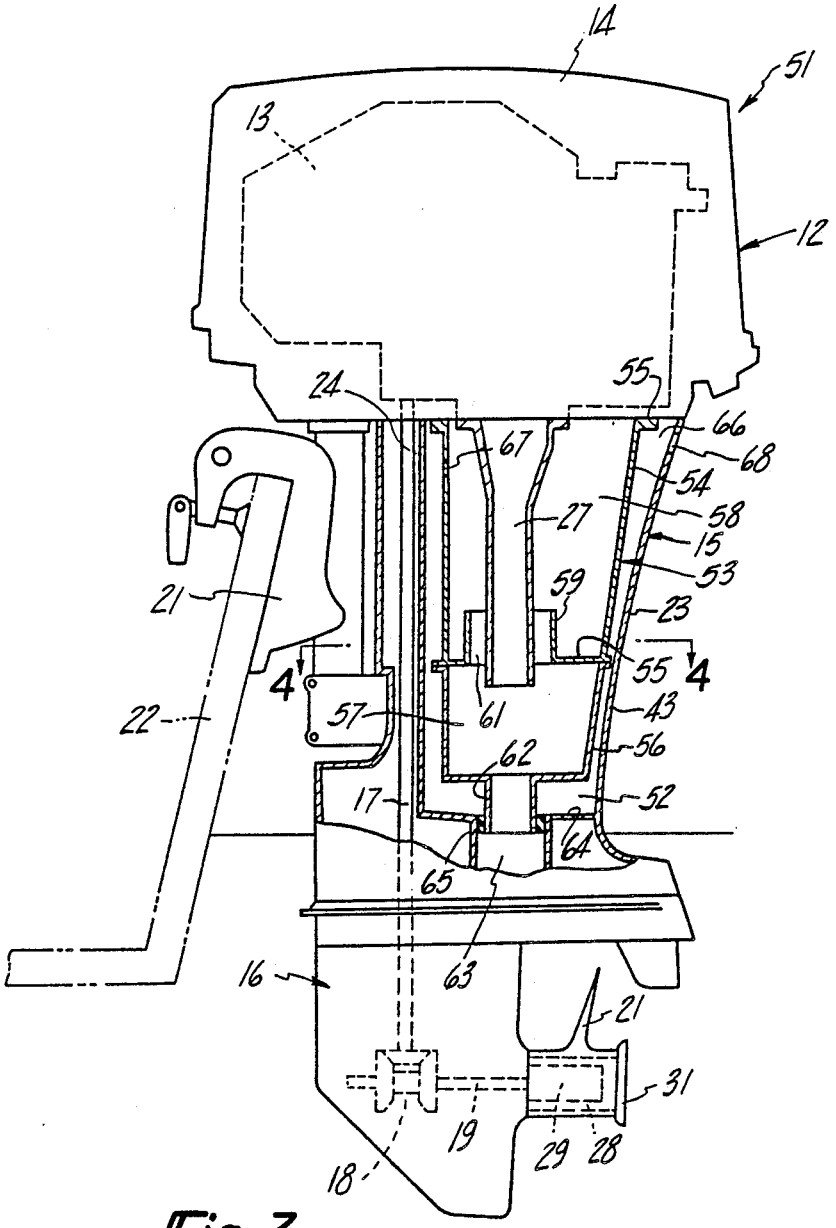
FIG. 3 is a side elevational view, with portions broken away, of an outboard motor constructed in accordance with another embodiment of this invention.

An outboard motor constructed in accordance with a second embodiment of the invention is illustrated in FIGS. 3 and 4 and is identified generally by the reference numeral 51. The main components of the motor 51 as well as their attachment to the associated watercraft are the same and, therefore, have been indicated by the same reference numerals.

In this embodiment, the drive shaft housing outer wall 23 defines an internal volume 52. Contained within the volume 52 is a cylindrical housing 53. The housing 53 is comprised of an upper member 54 that has an outstanding flange 55 for attachment to the engine 13 in surrounding relationship to the exhaust pipe 27. The upper housing 54 has a lower wall 55 to which a lower housing 56 is affixed in any known manner. The wall 55 divides the housing 53 into a lower expansion chamber 57 and an upper expansion chamber 58. The exhaust pipe 27 extends through the upper chamber 58 and terminates in the lower chamber 57. The wall 55 has an upstanding flange 59 that defines an annular air passage 61 that communicates the chambers 57 and 58 with each other.

The lower member 56 has a depending cylindrical section 62. The section 62 extends into an annular passage 63 formed in a lower wall 64 of the drive shaft housing 23. An annular seal 65 provides a seal between the cylindrical section 62 and the lower wall opening 63 so as to convey exhaust gases through the lower unit 16 for discharge through the propeller exhaust gas discharge 31.

The remaining portion of the cavity 52 around the housing 53 forms a third expansion chamber 66. Restricted communication is provided between the expansion chamber 58 and the expansion chamber 66 through a restricted opening 67 formed in the wall of the upper housing 54. This expansion chamber 66 functions, as in the previous embodiment, as a slow speed silencing device. Gases are discharged to the atmosphere from the expansion chamber 66 through an above the water, slow speed exhaust gas discharge 68 formed in the drive shaft housing rear wall 43.

This embodiment operates in a manner similar to the embodiment of FIGS. 1 and 2. During slow speed running when the propeller exhaust gas outlet 31 is relatively deeply submerged, the exhaust gases will flow from the exhaust pipe 27 into the first expansion chamber 57. These exhaust gases then expand and pass through the restricted opening 61 into the second expansion chamber 58. The exhaust gases then contract through the opening 67 and expand again in the expansion chamber 66. The exhaust gases, having undergone three expansions, then pass through the restricted exhaust gas discharge 68 to the atmosphere having thus been effectively silenced.

When running at intermediate or high speeds, the exhaust gases will leave the exhaust pipe 27 and expand in the expansion chamber 57. The chamber 58 and passageway 61 will act as a Helmholtz resonator so as to provide further silencing of the exhaust gases before they pass into the passage 63 for discharge through the high speed propeller discharge 31. As with the previously described embodiment, the exhaust pipe length 27 and volume of the expansion chamber 57 can be tuned to provide the desired silencing. In a like manner, the volume of the chamber 58 and the length and cross-sectional area of the passage 61 can be tuned so as to provide the desired silencing of the Helmholtz resonator. Also as with the previously described embodiment, the internal walls provided in the drive shaft housing strengthen this assembly and reduce the likelihood of vibration transmissions.

As has been previously noted, the invention is capable of use with motors other than those having through the propeller exhaust. In addition, it should be readily apparent that the respective partitioning walls may be made from separate elements connected to each other or may be formed from integral components. Various other changes and modifications may be made, without departing from the spirit and scope of the invention, as defined by the appended claims.

I claim:

1. In an exhaust system for an outboard motor having an engine with an exhaust outlet, an expansion chamber, means including an exhaust pipe for delivering exhaust gases from said exhaust outlet to said expansion chamber, an exhaust gas discharge normally disposed below the surface of the water when said motor is propelling a watercraft, and means for delivering exhaust gases from said expansion chamber to said exhaust gas discharge, the improvement comprising said exhaust pipe extending through a wall which divides said expansion chamber into two parts, said exhaust pipe extending though said first part and terminating in said second part, and an annular opening in said wall defined by an extending flange encircling said exhaust pipe and through which said exhaust pipe passes and which communicates said parts with each other and which forms a tuning neck.

2. In an exhaust system as set forth in claim 1 wherein the flange is an upstanding flange.

3. In an exhaust system as set forth in claim 1 wherein the first part has restricted communication with an above the water slow speed exhaust gas discharge for discharging exhaust gases directly to the atmosphere under slow speed running.

4. In an exhaust system as set forth in claim 3 wherein the restricted communication of the first part with the slow speed exhaust gas discharge is through a second expansion chamber.

5. In an exhaust system as set forth in claim 4 wherein there is a further third expansion chamber interposed between the second expansion chamber and the slow speed exhaust gas discharge.

6. In an exhaust system for an outboard motor having an engine with an exhaust outlet, a first expansion chamber, means for communicating exhaust gases from said exhaust outlet with said first expansion chamber, a high speed exhaust gas discharge normally disposed below the surface of the water when said motor is propelling a watercraft at speed, and means for delivering exhaust gases from said first expansion chamber to said high speed exhaust gas discharge, the improvement comprising a second expansion chamber communicating with said first expansion chamber through a tuned conduit and a slow speed exhaust gas discharge communicating said second expansion chamber with the atmosphere above the water level, the communication of said second expansion chamber with the atmosphere being substantially restricted relative to the communication between said first expansion chamber and said second expansion chamber for reducing the discharge of exhaust gases to the atmosphere through said slow speed exhaust gas discharge at high speeds and for causing said tuned conduit and said second expansion chamber to function as a Hemholtz resonator during high speed exhaust conditions by precluding any substantial exhaust gas discharge from said second expansion chamber to the atmosphere through said slow speed exhaust gas discharge.

7. In an exhaust system as set forth in claim 6 further including a third expansion chamber communicating with the second expansion chamber and through which the exhaust gases flow to the slow speed exhaust gas discharge.

8. In an exhaust system as set forth in claim 7 wherein the second and third expansion chambers have restricted communication with each other.

9. In an exhaust system as set forth in claim 6 wherein the first expansion chamber and the second expansion chamber are positioned in vertically spaced relationship and the means for delivering the exhaust gases to the first expansion chamber comprises an exhaust pipe extending through the second expansion chamber and terminating in the first expansion chamber.

10. In an exhaust system as set forth in claim 9 wherein a wall divides the first expansion chamber from the second expansion chamber and the wall has an opening through which the exhaust pipe passes, said opening being defined by an extending flange which forms the tuned conduit.

11. In an exhaust system as set forth in claim 10 further including a third expansion chamber communicating with the second expansion chamber and through which the exhaust gases flow to the slow speed exhaust gas discharge.

12. In an exhaust system as set forth in claim 11 wherein the second and third expansion chambers have restricted communication with each other.

13. An exhaust system for an outboard motor comprising a power head having an internal combustion engine with an exhaust outlet, a drive shaft housing depending from said power head and defining a cavity, a lower unit depending from said drive shaft housing and defining an exhaust discharge, a plurality of wall members extending transversely across said drive shaft housing cavity for dividing said cavity into at least three vertically spaced chambers at least one of which forms an expansion chamber and for reinforcing said drive shaft housing, means for communicating said chambers with each other, means for delivering exhaust gases from said exhaust outlet to one of said chambers comprising an exhaust pipe extending through one of said walls, said exhaust pipe extending through said expansion chamber and terminating in another of said chambers, an annular opening in said wall defining an extending flange encircling said exhaust pipe and through which said exhaust pipe passes to form a tuning neck and which communicates said other chamber with said expansion chamber, means for delivering exhaust gases from one of said chamber to said exhaust discharge and an above the water slow speed exhaust gas discharge extending through said drive shaft housing and in communication with one of the chambers.

14. In an exhaust system as set forth in claim 13 wherein the flange is an upstanding flange.

15. In an exhaust system as set forth in claim 13 wherein the first expansion chamber has restricted communication with the above the water slow speed exhaust gas discharge for discharging exhaust gases directly to the atmosphere under slow speed running.

16. In an exhaust system as set forth in claim 15 wherein the restricted communication of the first expansion chamber with the slow speed exhaust gas discharge is through a second expansion chamber.

* * * * *